US006608906B2

(12) United States Patent
Krochmal et al.

(10) Patent No.: US 6,608,906 B2
(45) Date of Patent: Aug. 19, 2003

(54) COOLING FAN CONTROL STRATEGY FOR AUTOMOTIVE AUDIO SYSTEM

(75) Inventors: Andrew Cyril Krochmal, Plymouth, MI (US); Gregory Roger Hamel, Livonia, MI (US); John Elliott Whitecar, Plymouth, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 23 days.

(21) Appl. No.: 10/034,049

(22) Filed: Dec. 27, 2001

(65) Prior Publication Data

US 2003/0138115 A1 Jul. 24, 2003

(51) Int. Cl.[7] ..... H04R 25/00
(52) U.S. Cl. ..... 381/189; 330/2
(58) Field of Search ..... 381/189, 124, 381/58, 56, 73.1, 71.3; 330/2

(56) References Cited

U.S. PATENT DOCUMENTS

| | | | | |
|---|---|---|---|---|
| 3,431,498 A | | 3/1969 | Varterasian et al. | 455/238.1 |
| 4,757,547 A | * | 7/1988 | Danley | 381/165 |
| 4,860,361 A | * | 8/1989 | Sato et al. | 381/55 |
| 4,933,987 A | | 6/1990 | Parks | 455/234.1 |
| 5,020,138 A | | 5/1991 | Yasuda et al. | 455/115 |
| 5,081,707 A | | 1/1992 | Schorman et al. | 455/186.1 |
| 5,381,719 A | | 1/1995 | Otsuka | 84/600 |
| 5,483,692 A | | 1/1996 | Person et al. | 455/238.1 |
| 5,649,015 A | * | 7/1997 | Paddock et al. | 381/61 |
| 5,907,622 A | | 5/1999 | Dougherty | 381/57 |
| 6,124,758 A | * | 9/2000 | Korte et al. | 330/124 R |
| 2001/0011200 A1 | * | 8/2001 | Kobayashi et al. | 701/36 |

FOREIGN PATENT DOCUMENTS

| | | |
|---|---|---|
| JP | 4208703 | 7/1992 |
| JP | 6098592 | 4/1994 |

* cited by examiner

*Primary Examiner*—Thomas J. Mullen, Jr.
(74) *Attorney, Agent, or Firm*—MacMillan, Sobanski & Todd LLC

(57) ABSTRACT

The masking-effect of loud audio passages is utilized to reduce the audibility of the fan noise from a cooling fan in an audio system. A power monitor determines an output power of an audio amplifier and generates a power signal proportional to the output power. A switchable cooling fan is positioned to provide a cooling flow of air within the audio system when the cooling fan is turned on. A fan control is coupled to the power monitor and the switchable cooling fan. The fan control compares the power signal with a predetermined threshold and turns on the switchable cooling fan in response to the comparison indicating that reproduction of the amplified audio signals is at an output power level that will substantially mask audible noise created by the switchable cooling fan.

13 Claims, 4 Drawing Sheets

COOLING FAN CONTROL STRATEGY FOR AUTOMOTIVE AUDIO SYSTEM

BACKGROUND OF THE INVENTION

The present invention relates in general to controlling a cooling fan in an audio system, and, more specifically, to running the cooling fan in a manner that masks audible noise generated by the cooling fan.

Amplifiers used in audio systems cannot be designed with 100 percent efficiency and, therefore, always generate heat. Other components of the audio system, including any microcontrollers or other integrated circuits, media player mechanisms (e.g., CD or cassette tape), displays, transistors, or other discrete components, also generate heat during operation. Heat can especially be a problem in automotive audio systems in which all these elements are housed within a single module or box. Heat buildup can lead to improper circuit operation or failure, audio distortion, undesirable surface heating, or heating of the audio media (e.g., a CD ejected from the system may be hot to the touch). Consequently, heat dissipation or removal is an important consideration for any audio system.

Heat exchange with ambient air is the primary method of removing heat from a typical audio system. In order to increase the heat exchange, a cooling fan may be provided for directing a flow of air through the audio system module so that fresh air is drawn from outside the module, over the heat-generating components, and back outside the module.

A drawback of using a cooling fan in an audio system is the noise generated by the fan itself. Unless great care and expense are taken in designing and manufacturing the cooling fan, the level of noise generated can be considered objectionable by many users of the audio system. Even when cost is not a limitation, all noise cannot be eliminated. Furthermore, damage or structural or electrical changes over time may increase the noise level that is generated.

Annoyance from fan noise can be minimized by running the fan intermittently, such as only when a certain amount of heat has built-up in the module. Many audio power amplifiers incorporate temperature sensing in their integrated circuits, but these typically only generate an output signal when the sensed temperature nears a level where a failure or improper operation may result (most audio systems use this signal to foldback or reduce the audio volume so that less heat is generated in the amplifier). Therefore, turning on the cooling fan in response to this signal is too late to prevent undesirable temperature levels. A separate temperature sensor can be used to sense the temperature within the module, but this adds an undesirable expense. Furthermore, intermittent operation of the cooling fan does not address the problem of audibility of the fan noise when the cooling fan is turned on.

SUMMARY OF THE INVENTION

The present invention has the advantage of providing a cooling fan control strategy that operates the fan so that audibility of fan noise is minimized. The present invention uses the masking-effect of loud audio passages to reduce the audibility of the fan noise.

In one aspect of the invention, an audio system for reproducing audio signals comprises an amplifier for amplifying the audio signals. A power monitor determines an output power of the amplifier and generates a power signal proportional to the output power. A switchable cooling fan is positioned to provide a cooling flow of air within the audio system when the cooling fan is turned on. A fan control is coupled to the power monitor and the switchable cooling fan. The fan control compares the power signal with a predetermined threshold and turns on the switchable cooling fan in response to the comparison indicating that reproduction of the amplified audio signals is at an output power level that will substantially mask audible noise created by the switchable cooling fan. Once the switchable cooling fan is turned on, the fan control keeps it turned on for a predetermined period. Even after the predetermined period, the switchable cooling fan is not turned off until the comparison indicates that reproduction of the amplified audio signals will no longer substantially mask audible noise created by the fan.

DETAILED DESCRIPTION OF PREFERRED EMBODIMENTS

Figure 1:
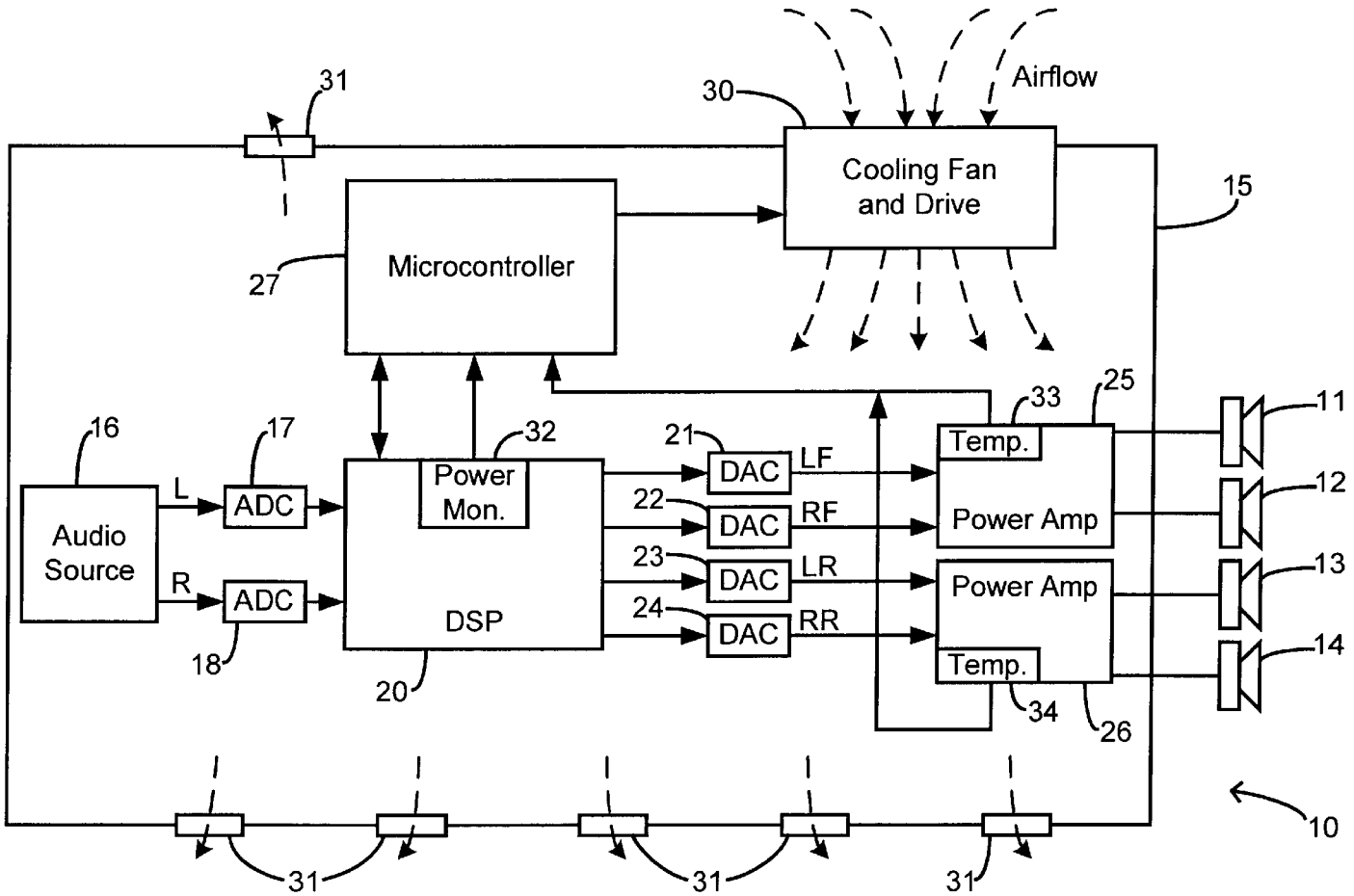
FIG. 1 is a schematic, block diagram showing an audio system of the present invention.

Referring to FIG. 1, an audio system 10 provides amplified audio reproduction signals to output transducers (i.e., loudspeakers) 11, 12, 13, and 14. In a preferred embodiment, audio system 10 is an automotive audio system and speakers 11–14 comprise right-front (RF), left-front (LF), right-rear (RR), and left-rear (LR) channels. Audio system 10 has an enclosure 15 which retains all the main heat-generating components of the audio system other than speakers 11–14. Nevertheless, the present invention is also applicable to enclosures containing only some of the heat-generating components (e.g., a separate power amplifier module).

Audio system 10 includes at least one audio source 16, such as an AM/FM tuner, a cassette tape mechanism, or a CD mechanism, for providing left and right stereo audio signals. In the preferred embodiment, digital signal processing is employed in audio system 10 for achieving superior performance at low cost and high packaging efficiency. For an analog audio source (e.g., a tuner or cassette tape), analog-to-digital converters 17 and 18 convert analog audio signals into digital audio signals for processing by a digital signal processor (DSP) 20. For a digital audio source, a direct connection may be provided to DSP 20 from audio source 16.

DSP 20 performs audio processing functions which are known in the art, including volume control, tone control, balance control, fade control, and special effects as determined by commands from a microprocessor 27, which in turn responds to user controls (e.g., input switches or push buttons, not shown). The processed digital audio signals from DSP 20 are coupled to digital-to-analog converters (DAC) 21–24, and the resulting analog signals are provided to power amplifiers 25 and 26 for driving speakers 11–14. Amplifiers 25 and 26 are two-channel (i.e., stereo) amplifiers for handling front and rear channels, respectively, and each may be comprised of a TDA8566 car radio power amplifier sold by Philips Semiconductors, for example.

A cooling fan assembly 30 includes an integral motor and a motor driver. The motor driver may simply be a switch for energizing a dc motor or may also include regulating circuitry or a power converter depending upon the type of motor being used. Microcontroller 27 provides a control signal for switching cooling fan 30 on and off. When turned on, cooling fan 30 creates an airflow as shown which draws outside air through cooling fan 30 into enclosure 15. Airflow escapes enclosure 15 through a plurality of outlets 31. Cooling fan 30 may be comprised of a 30×30 $mm^2$ fan AFB0312LA manufactured by Delta Electronics, Inc., for example.

The present invention uses the ability of loud sounds to mask a sound that is of a lower volume and is substantially unchanging (e.g., has a constant sound level and tone). In the preferred embodiment, cooling fan 30 is turned on when either of the conditions exists that 1) loud enough audio signals are being reproduced that audible fan noise will be substantially masked, or 2) a high temperature has been reached in the power amplifiers. Microcontroller 27 is connected to a power monitor 32 which indirectly infers the output power being expended in the power amplifiers based on the level of the DSP output signals to DACs 21–24. Since power amplifiers 25 and 26 typically provide a fixed amount of gain, the level of the DSP output signals is directly proportional to the power consumed by the power amplifiers. Alternatively, the actual outputs of the power amplifiers could be measured. Still other embodiments for determining output power of the amplifiers will occur to those skilled in the art. Since the greatest amount of heat is generated at times of loud audio output, by running cooling fan 30 during all times of loud audio output, the preferred embodiment achieves sufficient heat exchange so that elevated temperatures within the audio module are avoided under most conditions.

Power amplifiers 25 and 26 include thermal warning circuits 33 and 34, respectively. These provide a temperature warning signal in the event that an internal temperature of the power amplifiers reaches a threshold temperature (e.g., 150° C.). The temperature warning signals are provided to microprocessor 27 which turns on cooling fan 30 if the temperature warning signals occur, regardless of the loudness of the audio signals at that time.

Figure 2:
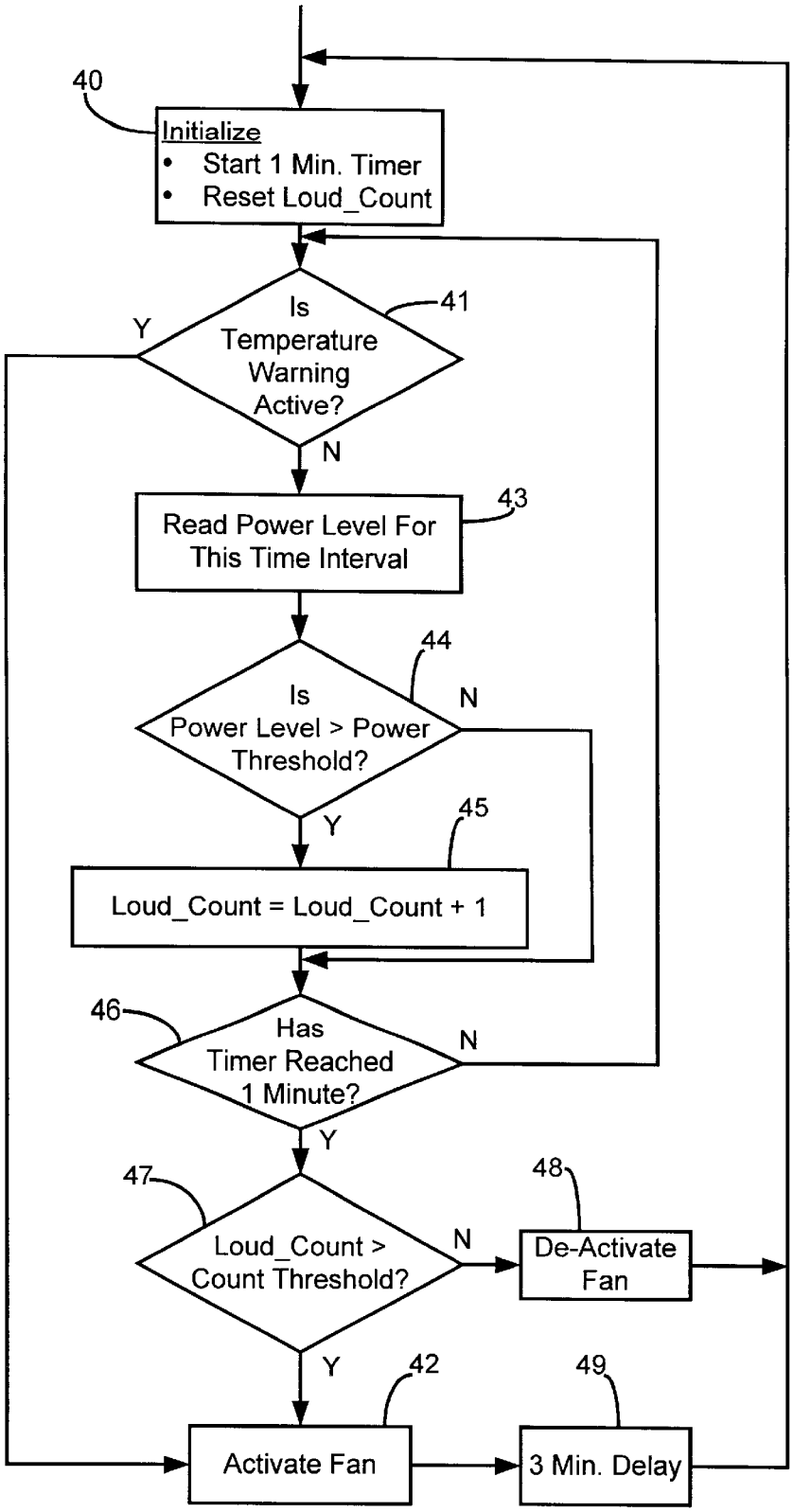
FIG. 2 is a flowchart showing a preferred fan control strategy of the present invention.

The overall fan control strategy of the preferred embodiment is shown in FIG. 2. In initialization step 40, a counter for counting a variable "Loud_Count" is reset and a timer is reset. The timer measures a time window, or equivalently a sample-count window, used to ensure that a loud and sustained section of audio material is present rather than just a short burst of loud sound during an overall quiet passage. A time window of about 1 minute is preferably employed, during which a plurality of output power samples are taken (preferably at regular intervals). The time window can be established by using a timer or by counting out a predetermined number of output power samples.

In step 41, a check is made to determine whether an active temperature warning signal is being received from any power amplifier. If such a warning signal is being received, then the cooling fan is turned on in step 42. Otherwise, a power level is determined in step 43 for the current time interval or sample interval within the overall 1-minute time window. Each sample or time interval may be about 1 second, for example. In step 44, the power level is compared to a power threshold which is chosen to represent a loudness which, if sustained for a long enough time, will audibly mask the fan noise. The power threshold takes into account the level of noise produced by the cooling fan, for example. If the instantaneous power level is greater than the power threshold, then Loud_Count is incremented by 1 in step 45, otherwise step 45 is skipped.

In step 46, a check is made to determine whether the 1-minute time window has expired (e.g., whether 60 power level samples have been taken at 1 second intervals). If not, then a return is made to step 41. Otherwise, Loud_Count is compared to a count threshold in step 47. The count threshold defines the extent to which loud power level measurements must dominate an audio passage from moment to moment (i.e., second to second) in order to achieve a desired masking effect. A count threshold in the range of about 50% (i.e., 30 samples out of 60 in the present example) may be employed. If Loud_Count exceeds the count threshold, then the cooling fan is activated in step 42. Otherwise, the cooling fan is deactivated in step 48 (unless it was not then active, in which case it is left in a deactivated state in step 48).

After the cooling fan is activated in step 42, it is left on for a predetermined delay period (e.g., 3 minutes) in step 49. This ensures a substantial amount of heat exchange can take place each time the cooling fan is started-up and avoids excessive cycling of the cooling fan which would be undesirable because fan noise would be most noticeable during its starting and stopping transients.

After the 3 minute delay of step 49 or the fan deactivation of step 48, a return is made to step 40 for re-initialization. If the cooling fan is running at the time of the return to step 40, it continues to run during the next series of power level measurements. Thus, the cooling fan will actually run for a minimum time of 4 minutes in the present example. Specifically, the cooling fan continues to run until a 1-minute time window is encountered which does not satisfy the count threshold (i.e., is not loud enough to audibly mask the fan noise). Consequently, the cooling fan is operated at substantially all times during which its audible noise will be masked, plus the short amount of time it takes to verify that sufficient loudness of the audio signal to achieve masking is no longer present.

Figure 3:
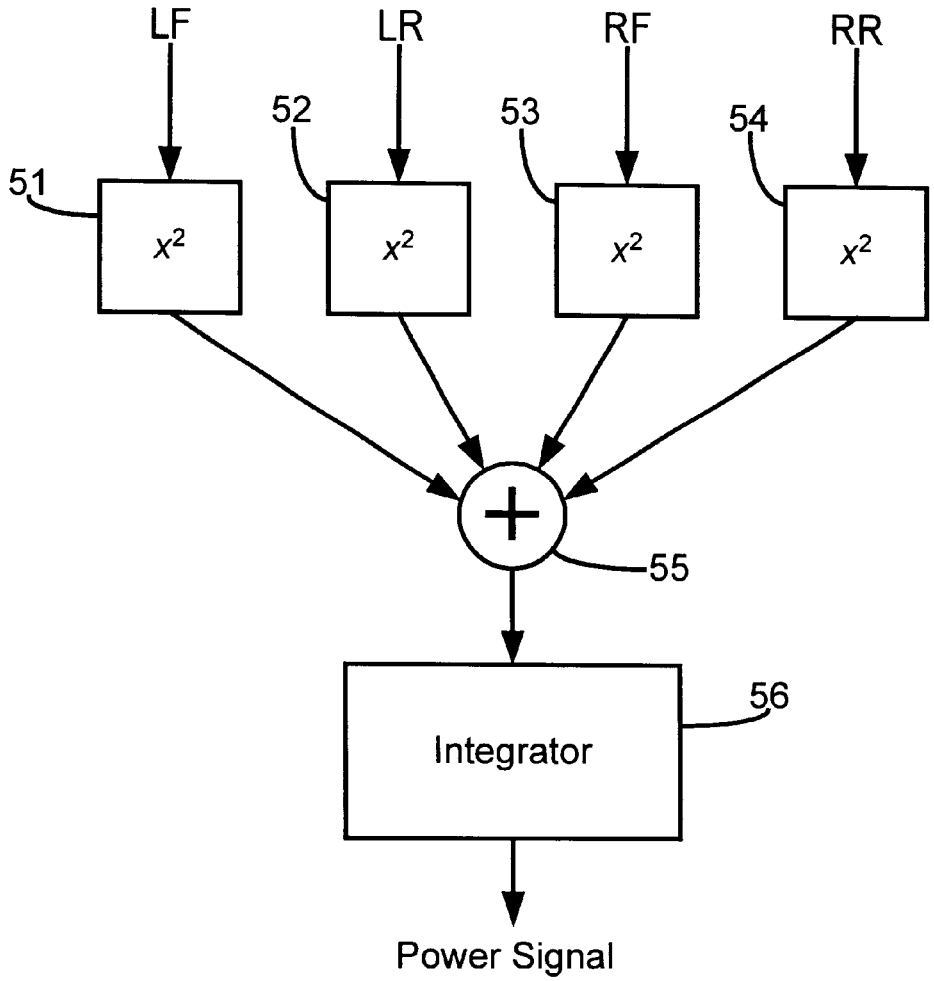
FIG. 3 is a schematic, block diagram showing a preferred method and apparatus for determining output power being consumed by the audio amplifiers.

FIG. 3 shows a preferred embodiment for determining the power level within an audio system using digital signal processing. Since power is proportional to voltage squared, each of the separate audio signal channels to be input to the power amplifiers (i.e., signals LF, LR, RF, and RR) is squared in a respective squaring block 51–54. The squared values from blocks 51–54 are added together in a summing block 55. The sum is integrated over a predetermined interval in an integrator 56. The predetermined interval preferably corresponds to the 1-second sampling interval of each power level sample. The power signal from integrator 56 may be provided from DSP 20 to microcontroller 27 for comparison to the power threshold as described above.

Figure 4:
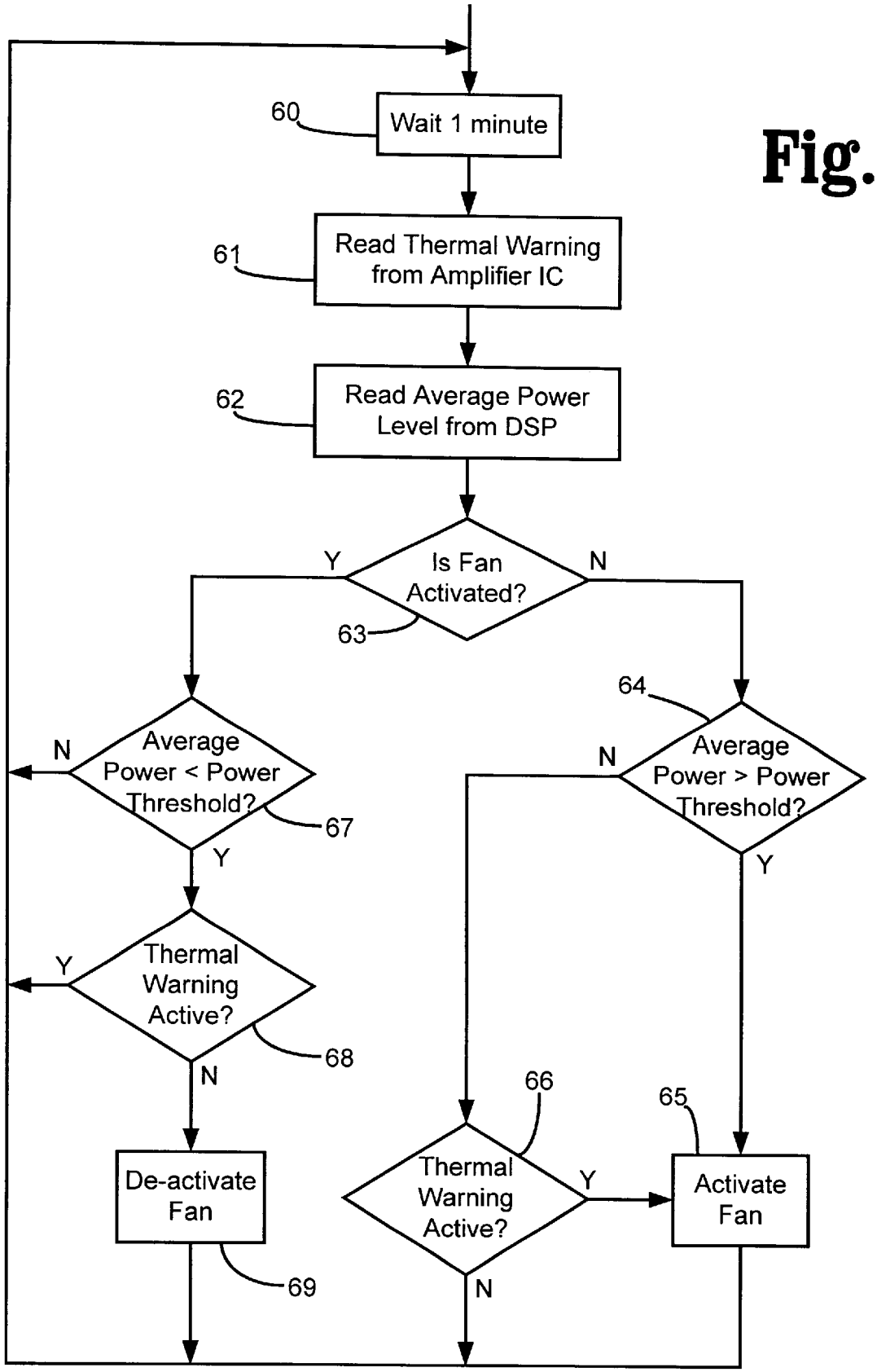
FIG. 4 is a flowchart of an alternative embodiment of a fan control strategy of the present invention.

FIG. 4 shows an alternative embodiment wherein a microcontroller is not required to take action during each individual power level measurement. Beginning at step 60, this alternate fan control method waits for about one minute (i.e., the microcontroller executes the fan control strategy once per minute). In step 61, the thermal warning register from the amplifier IC is read. During the 1-minute waiting period, power is measured within the DSP so that a measurement is available from the DSP that quantifies the average power during the previous minute. The microcontroller reads the average power level in step 62.

In step 63, a check is made to determine whether the fan is already on. If the fan is not activated, then a check is made in step 64 whether the average power level is greater than a power threshold. If greater than the threshold, then the fan is activated in step 65 and a return is made to step 60. Otherwise, a check is made in step 66 whether the thermal warning is active. If the thermal warning is active then the fan is activated in step 65, otherwise a return is made to step 60.

If step 63 determines that the fan is already activated, then a check is made in step 67 whether the average power level is less than the power threshold. If it is not, then a return is made to step 60. If the average power level is below the power threshold, then a check is made in step 68 to determine whether the thermal warning is active. If it is, then a return is made to step 60. If the thermal warning is not active, then the fan is de-activated in step 69 and a return is made to step 60.

What is claimed is:

1. An audio system for reproducing audio signals comprising:

an amplifier for amplifying said audio signals;

a power monitor for determining an output power of said amplifier and generating a power signal proportional to said output power;

a switchable cooling fan positioned to provide a cooling flow of air within said audio system when turned on;

a fan control coupled to said power monitor and said switchable cooling fan, said fan control comparing said power signal with a predetermined threshold and turning on said switchable cooling fan in response to said comparison indicating that reproduction of said amplified audio signals is at an output power level that will substantially mask audible noise created by said switchable cooling fan; and wherein said fan control performs a plurality of said comparisons of said power signal with said predetermined threshold during a predetermined time window, and wherein said fan control turns on said switchable cooling fan when a count of said comparisons for which said power signal is greater than said predetermined threshold exceeds a predetermined count.

2. The audio system of claim 1 wherein, once said switchable cooling fan is turned on, said fan control keeps said switchable cooling fan turned on for a predetermined period.

3. The audio system of claim 1 wherein, once said switchable cooling fan is turned on, said fan control continues to perform a plurality of said comparisons of said power signal with said predetermined threshold during another predetermined time window, and wherein said fan control turns off said switchable cooling fan when a count of said comparisons for which said power signal is greater than said predetermined threshold does not exceed said predetermined count.

4. The audio system of claim 1 further comprising:

a thermal warning circuit in said amplifier for providing a temperature warning signal in response to a measured temperature within said amplifier;

wherein said fan control is coupled to said thermal warning circuit and wherein said fan control turns on said switchable cooling fan whenever said temperature warning signal is present.

5. The audio system of claim 4 wherein, once said switchable cooling fan is turned on in response to said temperature warning signal, said fan control keeps said switchable cooling fan turned on for a predetermined period after said temperature warning signal is no longer present.

6. The audio system of claim 5 wherein, after said predetermined period, said fan control turns off said switchable cooling fan in response to said comparison indicating that reproduction of said amplified audio signals will no longer substantially mask audible noise created by said switchable cooling fan.

7. A method of operating a cooling fan for an audio system that reproduces audio signals using an amplifier, said method comprising the steps of:

generating a power signal indicative of an output power being consumed in said amplifier to reproduce said audio signals;

conducting a plurality of comparisons, each comparison comparing said power signal with a predetermined threshold;

counting a number of comparisons wherein said power signal exceeds said predetermined threshold;

comparing said number to a predetermined count; and if said number exceeds said predetermined count, then:

activating said cooling fan to provide a cooling flow of air within said audio system;

waiting for a predetermined delay, during which said cooling fan continues to be activated; and returning to said generating step.

8. The method of claimed 7 further comprising the steps of:

if said number does not exceed said predetermined count, then:

deactivating said cooling fan if it is currently activated, otherwise leaving it deactivated; and returning to said generating step.

9. The method of claim 7 further comprising the steps of:

monitoring a temperature within said amplifier and generating a temperature warning signal if said temperature exceeds a threshold temperature;

activating said cooling fan in response to said temperature warning signal;

waiting for said predetermined delay, during which said cooling fan continues to be activated; and returning to said monitoring step.

10. The method of claim 7 wherein said plurality of comparisons spans about one minute.

11. The method of claim 7 wherein said predetermined delay is equal to about three minutes.

12. The method of claim 7 wherein said amplifier is a multi-channel amplifier and wherein said generating step is comprised of squaring output signals from each channel of said amplifier, summing said squared output signals, and integrating said sum over a predetermined interval.

13. The method of claim 12 wherein said predetermined interval is equal to about one second.

* * * * *